US005669346A

United States Patent [19]

Leweux et al.

[11] Patent Number: 5,669,346

[45] Date of Patent: Sep. 23, 1997

[54] INTERNAL COMBUSTION ENGINE

[75] Inventors: Johannes Leweux, Esslingen; Hubert Schnüpke, Stuttgart; Albert Pietsch, Illingen, all of Germany

[73] Assignee: Mercedes-Benz AG, Stuttgart, Germany

[21] Appl. No.: 616,671

[22] Filed: Mar. 15, 1996

[30] Foreign Application Priority Data

Mar. 31, 1995 [DE] Germany ..... 195 11 864.2

[51] Int. Cl.[6] ..... F02F 7/00

[52] U.S. Cl. ..... 123/195 R; 123/195 H

[58] Field of Search ..... 123/195 R, 195 C, 123/198 E, 90, 27, 195 H

[56] References Cited

U.S. PATENT DOCUMENTS 1,242,285 10/1917 Watts .

4,951,623 8/1990 Jingu et al. ..... 123/195 C

FOREIGN PATENT DOCUMENTS 40 11 424 8/1993 Germany .

OTHER PUBLICATIONS

F. Anisits, O. Hiemesch, H. Krattochwill, F. Mundorff, "Der Neue BMW Sechszylinder Dieselmotor" MTZ Motortechnische Zeitschrift 52, (1991), pp. 486–493.

*Primary Examiner*—Noah P. Kamen

*Attorney, Agent, or Firm*—Klaus J. Bach

[57] ABSTRACT

In an engine block comprising a casting including side walls extending along a row of cylinders and front and rear walls extending between the side walls with top flanges for mounting a cylinderhead and bottom flanges for mounting an oil pan, the side walls have sections extending forwardly beyond the front wall to define therebetween a timing drive chamber.

5 Claims, 1 Drawing Sheet

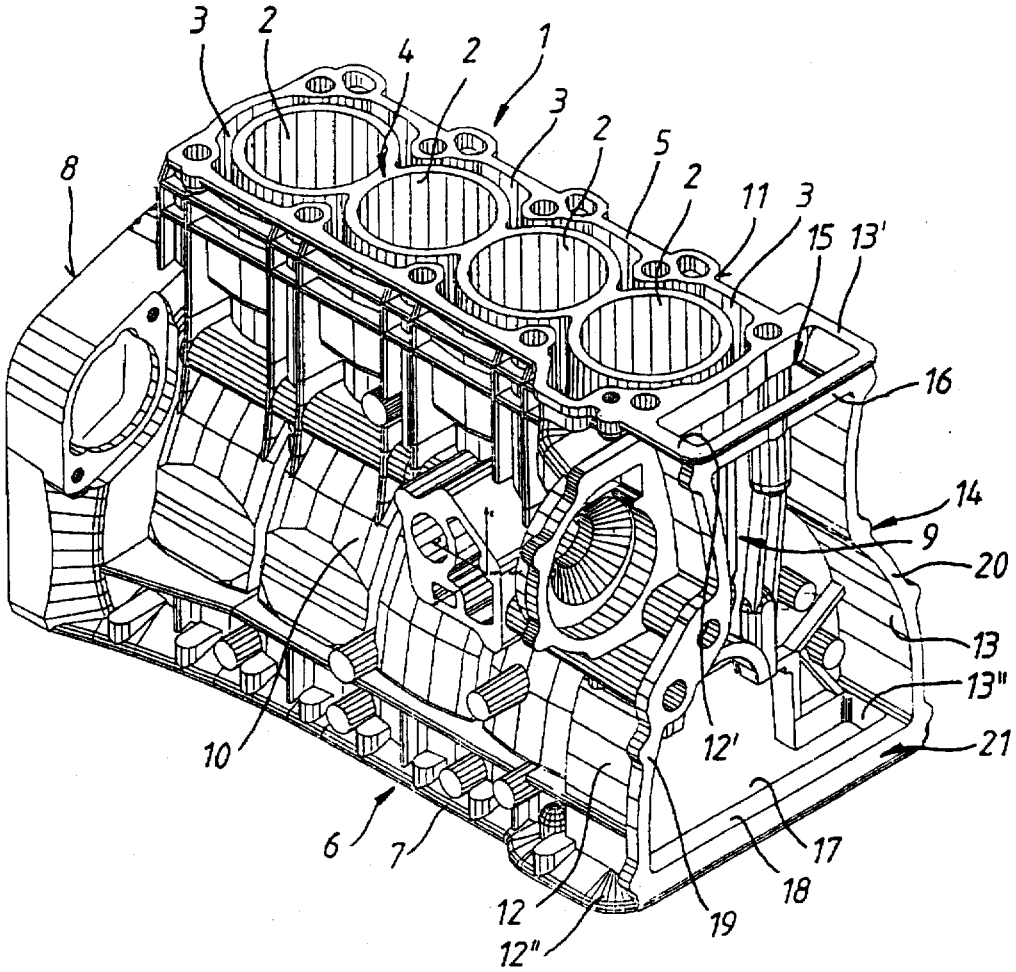
3
2
4
2
1
3
2
5
2
11
3
15
13'
8
16
14
9
20
13
13"
21
10
12'
6
7
17
18
12
12"
19

INTERNAL COMBUSTION ENGINE

BACKGROUND OF THE INVENTION

The invention relates to an internal combustion engine comprising an engine block with cylinder head, a crankcase with a crankshaft, a cam shaft and a chain or belt drive disposed on the front side of the crankcase and the engine block for transmitting motion from the crank shaft to the camshaft.

The publication MTZ Motortechnische Zeitschrift 52 (1991), No. 10, pages 486–493, discloses an internal combustion engine comprising a cylinderhead, a crankcase and an oil pan. The crankcase has two longitudinal sides and a lateral front side. The front side has a chain drive for rotating a camshaft mounted on the cylinder head. The front side has a V-belt drive system for operating a waterpump, an alternator and a radiator fan. These drive means, however, are V-belt drives. A valve cover partially encloses the chain drive, cam shaft and valve mechanism to prevent contamination from water and dirt. This cover extends downwardly to an edge of the oil pan. This pan projects outwardly beyond a crankcase front end. The cover requires a relatively large number of sealing ledges each having a sealing element. It is difficult to seal flange areas where there are three interconnected parts because of different temperature expansions. These parts expand in different directions and amounts.

It is the object of the present invention to provide an internal combustion engine block which utilizes fewer parts of simplified design such that the engine seals are simple and reliable.

SUMMARY OF THE INVENTION

In an engine block comprising a casting including side walls extending along a row of cylinders and front and rear walls extending between the side walls and having top flanges for mounting a cylinderhead and bottom flanges for mounting an oil pan, the side walls have sections extending forwardly beyond the front wall to define therebetween a timing drive chamber.

With the arrangement according to the invention, the engine side walls project forwardly beyond the chain or belt drive. Accordingly, the drive components are enclosed on the sides. The side wall extension are integrally cast with the engine block including the crankcase.

No separate manufacturing process is necessary herefor. The front ends may then be ground flat whereby the front seal structure becomes very simple as the seal surfaces are disposed in a single plane. Also, the seal surfaces maintain their shape. Areas, wherein different components are joined, are eliminated.

In a preferred arrangement, the side wall extensions define a transmission chamber with an opening adjacent the cylinderhead and an opening at the bottom adjacent the oil pan. With this arrangement, the chamber which is defined between the side wall projections is in communication with the area in which the camshaft gear is disposed and also with the space within the oil pan. As a result, the camshaft drive gear (chain drive) can be easily lubricated. Further, the oil can return to the oil pan without problems. Connecting ribs reinforce the projecting side walls and further simplify the sealing surfaces. One connecting rib extends between the upper ends of the projecting side wall portions. It delineates the opening adjacent the cylinder head. Another rib extends between the lower ends of the projecting side wall portions. It delineates the bottom opening adjacent the oil pan. It is further advantageous when the upper ends of the projecting side wall portions and, if suitable, the connecting rib extend in a common plane with the top surface of the engine block. This provides for a cylinder head flange surface with a uniform sealing frame for the respective sealing surfaces of the cylinder head. In a similar manner, the lower ends of the sidewall projections and, if suitable, the lower connecting rib extend in alignment with the oil pan flange of the crankcase. In this way, also the sealing surface of the oil pan is disposed in a plane. It is also advantageous if the front end faces of the projecting side wall portion and the front surfaces of the connecting ribs are disposed in a single plane. Then front the opening of the transmission chamber can be closed by a simple cover such as a flat plate.

An embodiment of the invention is described on the basis of the enclosed drawing.

BRIEF DESCRIPTION OF THE DRAWING

The sole FIGURE shows an engine block according to the invention.

DESCRIPTION OF A PREFERRED EMBODIMENT

In the FIGURE, the engine block 1 is shown in a perspective view. The engine block 1 includes four cylinder bores 2 which are arranged in line and which are surrounded by coolant channels 3. The upper side 4 of the engine block 1 provides for flange surfaces 5 on which a cylinder head can be mounted. The lower side 6 of the engine block which defines the engine crankcase forms a circumferential rim which serves as mounting flange 7 for an oil pan. The rear end 8 of the crankcase of the engine casing 1 is adapted to have a power transmission mounted thereon. The chamber 9 formed at the front end of the engine block receives a chain or belt drive for driving a camshaft. The side walls 10 and 11 extend between the rear end 8 and the front surfaces of the projecting side wall portions at the front of the engine block 1. They are sized and shaped depending on the respective number of cylinders, the size of the cylinders, the arrangement of the coolant channels, the arrangement of auxiliary components etc.

At its front end, the engine block 1 has sections 12, 13 integrally cast therewith which extend the side walls 10 11 beyond the engine front face 9. They also define a timing drive chamber 14 surrounding the chain or belt drive for the camshaft. Between the upper ends 12' and 13' of the side wall sections 12, 13 an opening 15 is formed adjacent the cylinder head. The opening 15 is limited by a connecting rib 16 extending between the upper ends 12' and 13' of the side wall sections 12, 13. The upper ends 12' and 13' of the side wall sections 12, 13 and also the rib 16 have top surfaces which are disposed in the same plane as the cylinder head flange surface 5. They form with the latter a uniform sealing surface frame. Between the lower ends 12" and 13" of the side wall sections 12, 13, there is an opening 17 adjacent the oil pan. This opening is limited by a connecting rib 18 extending between the lower ends 12" and 13" of the side wall sections 12, 13. The bottom surfaces of the connecting rib 18 and of the side wall sections 12,13 are disposed in the same plane with the bottom edge of the engine block. Together, they form a uniform sealing surface frame on which the oil pan is mounted.

As shown in the FIGURE, the timing drive chamber 14 is open toward the front which provides for easy access to the timing chain or timing belt. The timing drive chamber 14 is covered by a flat cover which extends across the front side. For this purpose, the front ends 19, 20 of the side wall sections 12, 13 and of the connecting ribs 16, 18 define a flat surface 21. The connecting ribs 16, 18 serve not only as sealing areas, but also improve the stiffness of the engine block 1.

Although the engine block is shown in the FIGURE with a front opening on the timing drive chamber 14, the engine block may be cast integrally with a timing drive chamber closed at its front. This further reduces the number of components and sealing surfaces needed with an engine.

What is claimed is:

1. An engine block comprising a casting including side walls extending along a row of cylinders, and front and rear walls extending between said side walls in front of said row of cylinders said side-, front- and rear walls having top flange surfaces for mounting a cylinder head and bottom flange surfaces for mounting on oil pan to said engine block, said side walls having sections extending forwardly beyond said front wall and defining therebetween a timing chamber adapted to receive the timing gear for driving a cam shaft mounted on said cylinder head, said timing chamber having top and bottom openings, and a rib extending between the lower ends of said side wall projections and limiting said bottom opening.

2. An engine block according to claim 1, wherein a rib extends between the upper ends of said side wall section and limits said top opening.

3. An engine block according to claim 2, wherein said top flange surfaces and the upper ends of said side wall sections and of said rib are all disposed in the same plane.

4. An engine block according to claim 1, wherein said engine block has flat lower flanges and said projecting side wall portions and said rib have lower edges disposed in the same plane with said lower flanges.

5. An engine block according to claim 1, wherein a rib extends between the upper ends and between the lower ends of said projecting side wall sections and said projecting side wall sections and said ribs have front surfaces which are all disposed in the same plane.

* * * * *